US007537128B2

(12) United States Patent
Nachumi

(10) Patent No.: US 7,537,128 B2
(45) Date of Patent: May 26, 2009

(54) NURSING BOTTLE VENT SYSTEM

(76) Inventor: Amir Nachumi, 37 Aya Street, Ramat HaSharon (IL) 47226

( * ) Notice: Subject to any disclaimer, the term of this patent is extended or adjusted under 35 U.S.C. 154(b) by 0 days.

(21) Appl. No.: 10/998,335

(22) Filed: Nov. 29, 2004

(65) Prior Publication Data

US 2006/0124573 A1 Jun. 15, 2006

(51) Int. Cl.
*A61J 9/04* (2006.01)

(52) U.S. Cl. ..... 215/11.5; 215/11.1; 215/399; 215/902; 220/DIG. 27

(58) Field of Classification Search ..... 215/11.4, 215/11.5, 902, 11.1, 307, 388; 222/188; 220/366.1, 367, 745, DIG. 2, 714
See application file for complete search history.

(56) References Cited

U.S. PATENT DOCUMENTS

| | | | | |
|---|---|---|---|---|
| 979,607 | A | 12/1910 | Van Cleave | |
| 2,744,646 | A | 5/1956 | Blackstone | |
| 3,254,809 | A | 6/1966 | Breneman | |
| 3,628,704 | A * | 12/1971 | Corsette | 222/513 |
| 5,054,660 | A | 10/1991 | Sherman et al. | |
| 5,269,444 | A | 12/1993 | Wright | |
| 5,284,262 | A | 2/1994 | O'Nan | |
| 5,449,098 | A | 9/1995 | Offman | |
| 5,570,796 | A | 11/1996 | Brown et al. | |
| 5,678,710 | A | 10/1997 | Sheu | |
| 5,779,071 | A | 7/1998 | Brown et al. | |
| 2004/0118801 | A1 * | 6/2004 | Brown et al. | 215/11.1 |

FOREIGN PATENT DOCUMENTS

| | | |
|---|---|---|
| DE | 19601198 C1 | 7/1997 |
| SE | 82001470 | 1/1982 |

* cited by examiner

*Primary Examiner*—Sue A. Weaver
(74) *Attorney, Agent, or Firm*—Steven W. Webb

(57) ABSTRACT

An improved nursing bottle is presented which possess a novel venting system that allows ambient air to enter the nursing bottle to equalize internal and external pressures and prevent nipple collapse. Preventing nursing bottle nipple collapse reduces the amount of sucking by infants required to extract milk from the bottle and eliminates air in the infant's stomach. Liquid is prevented from exiting the nursing bottle by means of capillary action. The invention can be utilized with any standard nursing bottle.

1 Claim, 3 Drawing Sheets

NURSING BOTTLE VENT SYSTEM

FIELD OF THE INVENTION

The invention relates to nursing bottles. More particularly, the invention relates to nursing bottles taking advantage of an air vent to equalize the interior pressure of the bottle with outside air pressure during use.

BACKGROUND OF THE INVENTION

Babies are born with the instinct to suckle milk from their mother's breasts, but it is often necessary for them to drink liquids from other sources. It is common throughout the world to feed liquids to babies in nursing bottles, also known as baby bottles. A nursing bottle is used by filling cylindrical container with liquid, securing a flexible nipple to the open end of the container, inverting the bottle, and placing the nipple into the baby's mouth. The baby then sucks on the nipple to drink the liquid. None of these nursing bottles completely solves the problem of maintaining the interior of the bottle at atmospheric pressure while preventing leaks and spills. They also do not provide a simple user-friendly system for mothers. Accordingly, a demand still exists for a nursing bottle, which prevents the formation of a partial vacuum inside the bottle during nursing yet does not result in spills, and is simple to use.

SUMMARY OF THE INVENTION

The invention is an improved nursing bottle and vent system to be filled with liquid and capped with a nipple. The interior of the nursing bottle remains at atmospheric pressure when the bottle is inverted during use. The vent system comprises: a vertical double-ended capillary tube, a wheel-and-spoke shaped circular insert that has a radially central housing for the capillary tube with a plurality of open air passages from the capillary tube to the screw threads of the container.

Fluid passes from the bottle to the nipple through the spokes of the wheel comprising the insert. When the bottle is inverted, an air passage is established from the open end of the capillary tube down inside the container to the vents in the insert spokes to the screw thread area of the container top, to carry ambient air into the container and thereby maintain atmospheric pressure.

The general object of this invention is to provide an improved vent system that will be applicable to any approved and in-use nursing bottle. A more particular object is to provide a vent system, which prevents the formation of a partial vacuum inside the bottle during nursing, yet does not result in spills.

It is another object of this invention, as an alternate embodiment, to provide a nursing bottle vent system which does not need cleaning because it is disposable.

DETAILED DESCRIPTION OF THE INVENTION

Figure 1:
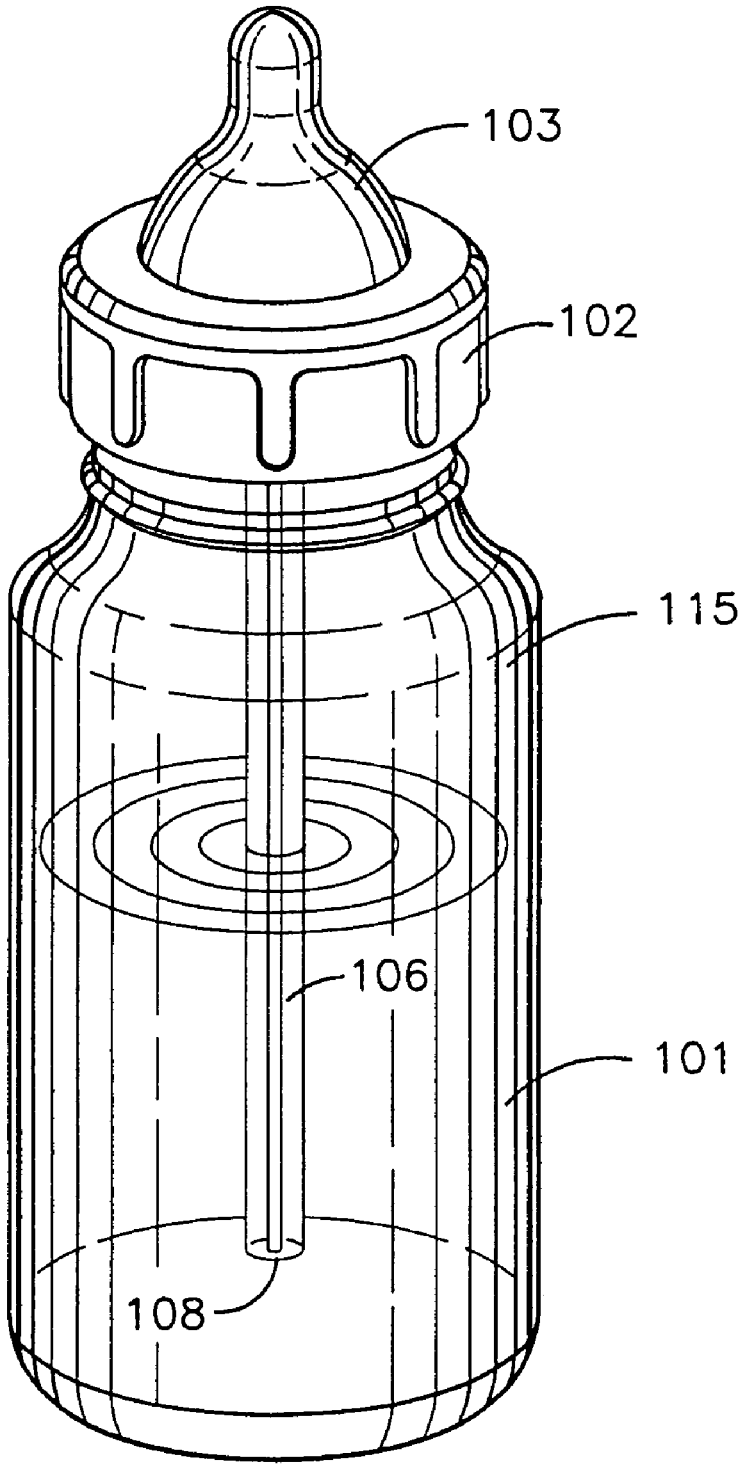
FIG. 1 is perspective view of the assembled invention
Figure 2:
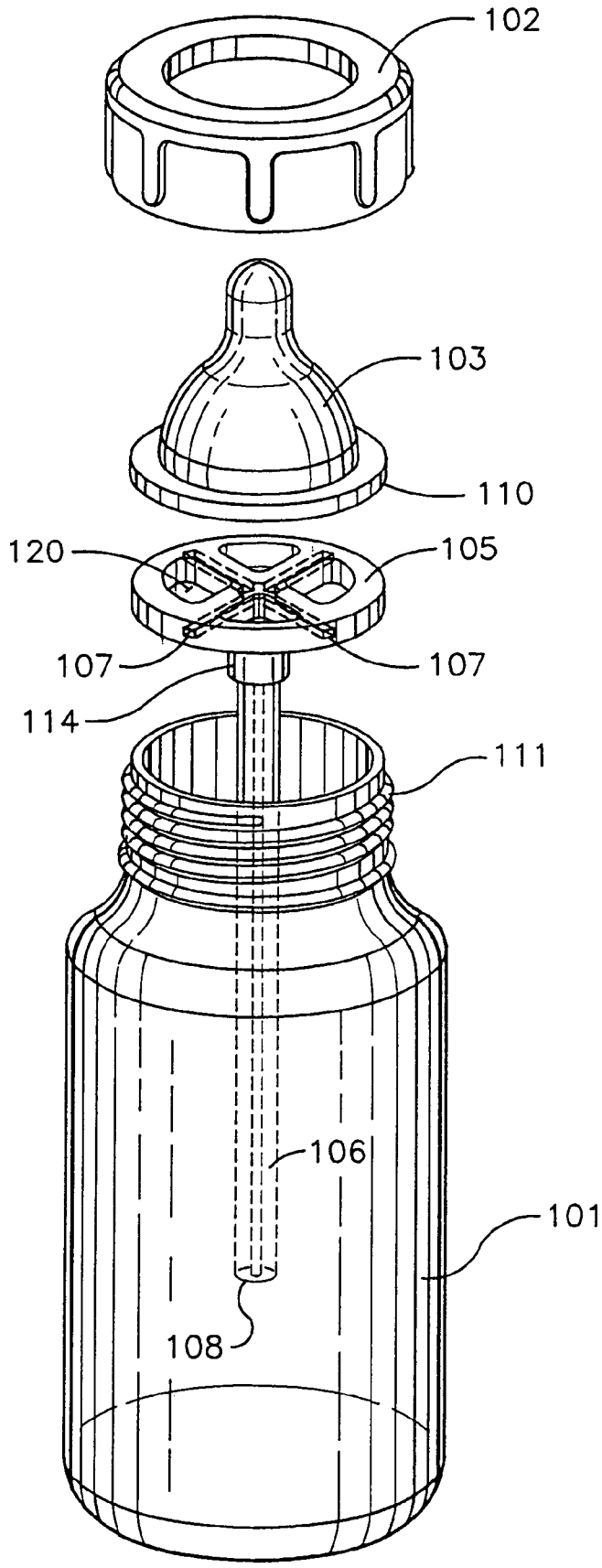
FIG. 2 is an exploded view of the invention
Figure 3:
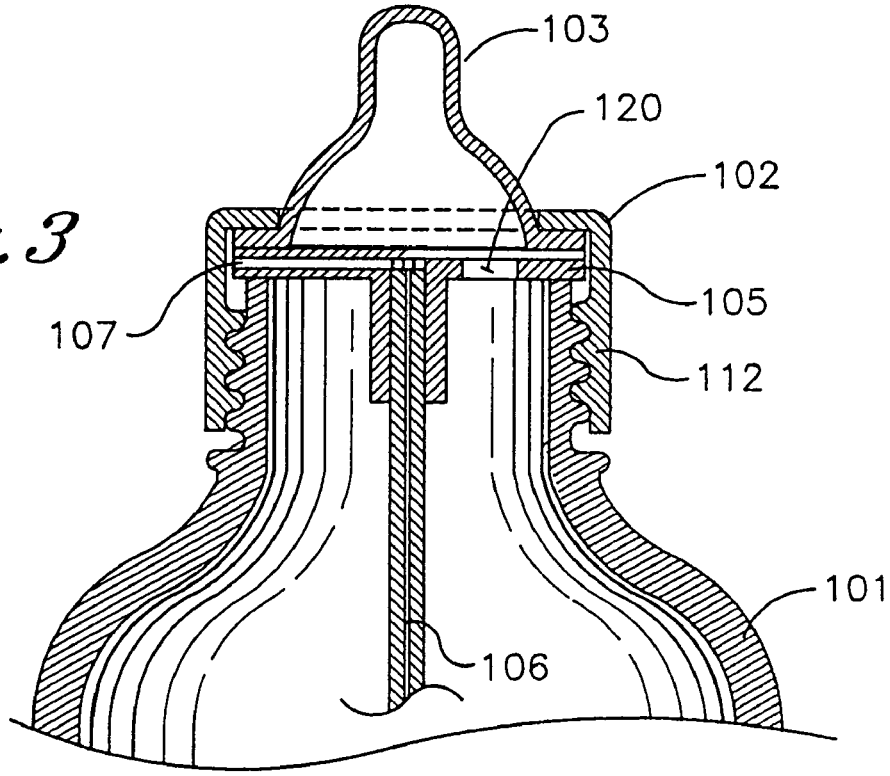
FIG. 3 is a cross-section of the top of the invention
Figure 4:
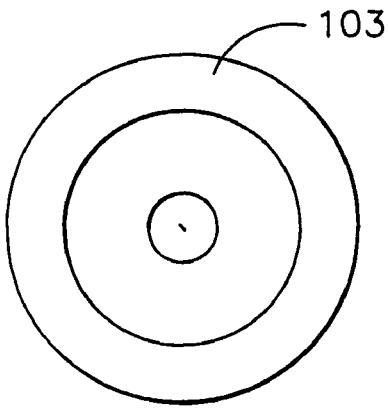
FIG. 4 is a bottom view of the nipple
Figure 5:
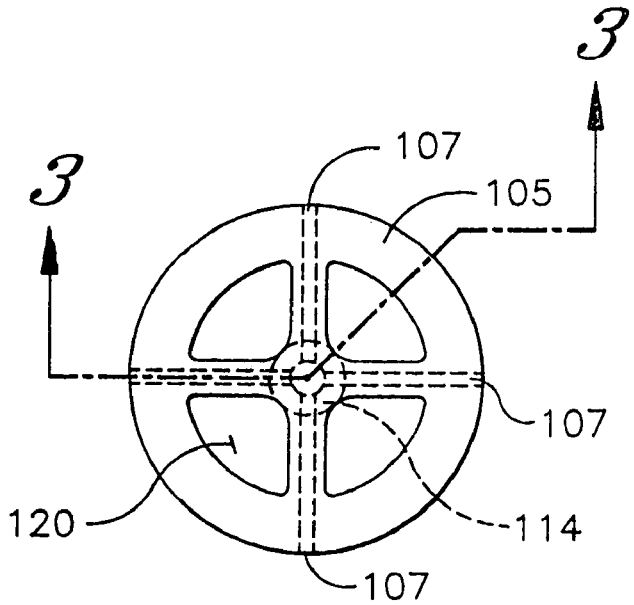
FIG. 5 is a top view of the insert

FIGS. 1 and 2 show the preferred embodiment of the vent system. The vent system contains two components, a wheel-and-spoke shaped insert 105, and a capillary tube 106. The two components are separate and capable of easy disassembly and reassembly for ease of cleaning and replacement.

A conventional nipple 103 and nipple cap 102 is shown in FIG. 2. Although the nipple 103 and nipple cap 102 are not part of this invention, the insert 105 part of this invention makes use of the base 110 of the nipple 103 to create the ambient air passage with the plurality of tunnels 107 of the insert 105. The nipple 103 usually includes a flat rubber circular base 110, which usually rests on the nursing bottle neck 111.

The insert 105 of this invention is designed to match the nipple base 110 dimensions of available nipples 103. The tunnels 107 in the insert 105 are completely enclosed inside the insert 105, and lead air from the screw threads 112 to the central housing 114 of the insert 105. The nipple cap 102 attaches to the bottleneck 111 by means of the screw threads 112, the insert 105 of this invention is pressed against the nipple 103 by means of the pressure exerted by the screw threads 112 when the nipple cap 102 is screwed on.

The insert 105 is molded as a single piece, and has a central housing 114 to receive the capillary tube 106. When the nursing bottle 101 is assembled for use, the capillary tube 106 fits into the central housing 114 of the insert 105 by frictional fit. The frictional fit is sufficient to provide a seal and thereby prevent liquid from escaping.

The capillary tube 106 extends to a point near the bottom of the nursing bottle 101. The open end of the capillary tube 106 should be within about 1 cm of the bottom of the bottle. This point needs to be in the bottle's air space when the bottle 101 is inverted.

The liquid in the container should not exceed a certain level. In FIG. 1, a line 115 permanently marked on the side of the bottle 101 shows the maximum liquid level. This marked line 115 is typically at or about the point of equalizing between the liquid and the capillary tube 106.

The second component of the preferred embodiment of the vent system is the capillary tube 106. The capillary tube open end 108 is near the bottom of the bottle 101. When the bottle 101 is upright and contains liquid, the liquid enters the capillary tube open end 108 and reaches the same level inside the capillary tube 106 as in the bottle 101.

The primary purpose of the capillary tube 106 is to provide a passage for ambient air into the bottle 101 when it is inverted and the liquid contents are being withdrawn through the nipple 103. To achieve the capillary action, the cross-sectional area of the liquid inside the capillary tube 106 is very small. A cross section of 0.025 sq. mm is adequate.

When the bottle 101 is inverted, the outside pressure over the inside pressure will force the very small amount of liquid in the capillary tube 106 to flow back into the bottle 101, clearing the capillary tube 106 for ambient air to enter the interior of the bottle 101 by flowing through the air tunnel formed by the insert 105 and the capillary tube 106. Liquid will flow normally from the bottle through the spaces 120 between the spokes of the insert 105.

The operation of the preferred embodiment of this invention is as follows. An appropriate-sized nursing bottle is obtained. The capillary tube 106 is inserted into the central housing 114 in the insert 105. These two components are then placed in the bottle as in FIG. 2 and the nipple 103 is placed over the insert 105 as shown. The nipple cap 102 is then screwed down over the nipple 103 as usual and the nipple cap 102 holds the base of the nipple 103 against the top of the insert so that the plurality of tunnels 107 in the insert 105 form a passage to the outside air.

Because of its placement in the bottle 101, the capillary tube 106 is then filled with liquid. The liquid level in the tube should not substantially exceed the marked fill line, i.e., the point of equalizing between the liquid level in the bottle and the tube. When the bottle 101 is inverted, the liquid in the capillary tube 106 remains in the tube due to the capillary effect. This phenomenon ensures that: this amount of liquid small as it may be (due to the tiny section of the capillary tube), will not spill out through the insert tunnel 107). Immediately after the nursing starts, the decrease in air pressure in the bottle 101 will force the ambient air to enter the interior of the bottle 101 by flowing through the plurality of tunnels 107 of the insert 105 and the tube 106. Thus, the interior of the bottle 101 will remain at ambient atmospheric pressure during use and the baby nursing from the bottle is not forced to suck so hard that air is inadvertently swallowed. As a result, the chances of colic are greatly reduced.

While the preferred embodiment of the invention has been described, modifications can be made and other embodiments of this invention realized without departing from the intent and scope of any claims associated with this invention.

What is claimed is:

1. A nursing bottle vent system comprising a flexible insert and a flexible capillary tube, the flexible insert in the shape of a wheel with a plurality of spokes, the outside diameter of the flexible insert the same as the outside diameter of the neck of a standard nursing bottle, the flexible insert possessing a cylindrical central housing at the center of the wheel shape, the central housing serving as the hub of the plurality of spokes of the wheel shape, the central housing possessing a cylindrical receptor coaxial with it, the cylindrical receptor and the plurality of spokes connected to each other, the plurality of spokes each possessing a longitudinal tunnel, each tunnel running the length of the spoke and connecting to an opening in the central housing and an opening in the outside of the insert, the flexible capillary tube a hollow tube with a tube tunnel, the diameter of the tube tunnel sufficiently small to create a capillary effect, the outside diameter of the flexible capillary tube the same as the inside diameter of the cylindrical receptor in the central housing, the flexible capillary tube capable of being inserted into the cylindrical receptor and being held in place by friction, the combination of flexible capillary tube inserted into central housing by means of placing within the cylindrical receptor providing a continuous passageway for air from the flexible capillary tube to the plurality of tunnels in the spokes of the flexible insert, the nursing bottle vent system assembled by connecting the flexible capillary tube to the cylindrical receptor in the central housing, placing the assembly of flexible capillary tube and central housing into a standard nursing bottle such flat the flexible capillary tube extends down into the nursing bottle and the flexible insert fits over the neck of the nursing bottle, placing a standard nursing bottle nipple over the flexible insert, and then screwing down a standard nursing bottle nipple cap over the nipple onto the nursing bottle neck, the nursing bottle vent system capable of maintaining equal air pressure between the outside air and the interior of the nursing bottle, the air pressure equalized by means of the continuous air passage from the interior of the bottle to the outside provided by the flexible capillary tube connection to the flexible insert and the plurality of tunnels within the spokes of the flexible insert.

* * * * *